US011555611B2

(12) United States Patent
Chen et al.

(10) Patent No.: US 11,555,611 B2
(45) Date of Patent: Jan. 17, 2023

(54) FEEDFORWARD STRUCTURE FOR CONTROLLING STEAM DRUM WATER LEVEL IN STEAM TURBINE FCB TEST AND CONTROL METHOD FOR THE SAME

(71) Applicant: China Energy Engineering Eastern Electric Power Testing Research Institute Co., Ltd., Hangzhou (CN)

(72) Inventors: Guoqing Chen, Hangzhou (CN); Yao Sun, Hangzhou (CN); Tingfeng Wang, Hangzhou (CN); Zhizhou Li, Hangzhou (CN); Hailong Qian, Hangzhou (CN); Feng Huang, Hangzhou (CN); Xiaomin Fang, Hangzhou (CN)

(73) Assignee: China Energy Engineering Eastern Electric Power Testing Research Institute Co., Ltd., Hangzhou (CN)

( * ) Notice: Subject to any disclaimer, the term of this patent is extended or adjusted under 35 U.S.C. 154(b) by 15 days.

(21) Appl. No.: 17/445,446

(22) Filed: Aug. 19, 2021

(65) Prior Publication Data

US 2022/0057082 A1 Feb. 24, 2022

(30) Foreign Application Priority Data

Aug. 20, 2020 (CN) ..... 202010842572.X

(51) Int. Cl.

| | |
|---|---|
| ***F22D 5/30*** | (2006.01) |
| ***F22B 37/78*** | (2006.01) |
| *F01D 21/00* | (2006.01) |

(52) U.S. Cl.

CPC ..... *F22D 5/30* (2013.01); *F22B 37/78* (2013.01); *F01D 21/003* (2013.01); *F05D 2220/31* (2013.01)

(58) Field of Classification Search

CPC .... F01D 21/003; F05D 2220/31; F22B 37/78; F22D 5/30

See application file for complete search history.

(56) References Cited

U.S. PATENT DOCUMENTS

| | | | | |
|---|---|---|---|---|
| 4,433,646 | A * | 2/1984 | Zadiraka | F22B 37/42 122/504 |
| 4,854,121 | A * | 8/1989 | Arii | F22D 5/30 60/39.182 |
| 11,480,101 | B1 * | 10/2022 | Honjas | H01L 35/30 |
| 2005/0257613 | A1 * | 11/2005 | Spencer | G01F 23/02 73/323 |
| 2011/0295432 | A1 * | 12/2011 | Kumar | F22B 1/1815 703/2 |

(Continued)

*Primary Examiner* — Eric S. McCall

(74) *Attorney, Agent, or Firm* — McNees Wallace & Nurick LLC

(57) ABSTRACT

The present disclosure relates to a feedforward structure for controlling water level, in particular to a feedforward structure for controlling a steam drum water level in a steam turbine FCB test and a control method therefor. The feedforward structure includes a steam drum provided with a steam drum water level measurement sensor therein, a feed water pipe provided with a feed water flow measurement sensor therein, and a steam inlet pipe provided with a steam flow measurement sensor therein. A steam drum water level measurement value I in the steam drum water level measurement sensor is compared with a set value of the steam drum water level.

2 Claims, 1 Drawing Sheet

(56) References Cited

U.S. PATENT DOCUMENTS

| | | | | |
|---|---|---|---|---|
| 2013/0145998 | A1* | 6/2013 | Wilhelm | F22B 37/78<br>122/448.4 |
| 2013/0276530 | A1* | 10/2013 | Kanasaki | G01F 23/14<br>73/290 R |
| 2022/0282639 | A1* | 9/2022 | Hamasaki | C02F 1/66 |

* cited by examiner

FEEDFORWARD STRUCTURE FOR CONTROLLING STEAM DRUM WATER LEVEL IN STEAM TURBINE FCB TEST AND CONTROL METHOD FOR THE SAME

CROSS REFERENCE TO RELATED APPLICATION

This application claims the priority of Chinese Patent Application No. 202010842572.X, entitled "Feedforward Structure for Controlling Steam Drum Water Level in Steam Turbine FCB Test and Control Method for the Same" filed with the Chinese Patent Office on Aug. 20, 2020, which is incorporated herein by reference in its entirety.

TECHNICAL FIELD

The disclosure relates to a feedforward structure for water level control, in particular to a feedforward structure for controlling steam drum water level in a steam turbine FCB test and a control method for the same.

BACKGROUND ART

During a fast cut back (FCB) test or a load rejection test, an over-speed protection control (OPC) function is triggered at a steam turbine side in advance, to quickly close a steam inlet control valve, quickly open high and low pressure bypasses, and open a pressure control valve at boiler side, so that a main steam pressure at the steam turbine side rises sharply and then drops sharply. Meanwhile, a main steam flow is dropped sharply so as to cause a steam drum water level to rise rapidly, resulting in a false water level. In the cast that the steam drum water level is controlled in a conventional three-impulse mode, a feed water control system will quickly reduce water supply to cause the water level to rise briefly and then drop sharply, leading to the fact that the drum water level is low, which triggers a main fuel trip (MFT) protection action of a boiler.

SUMMARY

The present disclosure mainly solves deficiencies in the prior art, and provides a feedforward structure for controlling steam drum water level in a steam turbine FCB test and a control method for the same. The present disclosure can automatically switch a feedforward steam flow converted based on a main steam pressure by feed water control system to a feedforward steam flow converted based on steam production per ton of coal of a boiler when a turbine unit triggers a FCB operating condition or a load rejection test. The feedforward structure can avoid a non-computable bypass flow during the FCB or load rejection test, and enable a steam drum water level of the turbine unit to be controlled. The feedforward structure also prevents the steam drum water level from being too low to trigger a MFT protection action of a boiler.

The above-mentioned technical problems of the disclosure are mainly solved by the following technical solutions:

A feedforward structure for controlling steam drum water level in steam turbine FCB test includes a steam drum provided with a steam drum water level measurement sensor therein, a feed water pipe provided with a feed water flow measurement sensor therein, and a steam inlet pipe provided with a steam flow measurement sensor therein. A steam drum water level measurement value I in the steam drum water level measurement sensor is compared with a set value of the steam drum water level.

The steam drum water level measurement sensor generates a main signal, any change of the steam drum water level caused by disturbances changes an output signal of a regulator to change a feed water flow, so as to restore the steam drum water level to the set value.

The steam flow measurement sensor generates a feedforward signal, which prevents the regulator from performing an erroneous operation due to a false water level, and improve regulation quality when a steam flow is disturbed.

The feedforward signal representing the steam flow and a signal representing the feed water flow work together to eliminate a static deviation of a feed water control system.

When the feed water flow changes, a differential pressure of a transmitter changes quickly and reflects the change of the feed water flow in time. A feed water flow signal representing the feed water flow is used as a media feedforward signal, base on which the regulator eliminates internal disturbances when the steam drum water level has not changed, such that a regulation process by the regulator is stable and the feed water flow is stabilized.

The present disclosure provides a control method for the feedforward structure for controlling steam drum water level in steam turbine FCB test, and includes the following steps of:

Quickly closing a steam inlet control valve by triggering an overspeed protection control (OPC) function at a side of the steam turbine in advance, quickly opening high and low pressure bypasses, and opening a pressure control valve at a side of a boiler during the FCB test of the steam turbine or a load rejection test, such that a main steam pressure at the side of the steam turbine rises sharply and then drops sharply which causes the steam drum water level to rise rapidly, resulting in the false water level. In a case that the steam drum water level is controlled in a conventional three-impulse mode, the feed water control system quickly reduces water supply, then the steam drum water level rises briefly and then drops to a dangerous water level sharply. However, the steam flow feedforward of the feed water control system is switched to a converted steam flow based on a design total fuel amount through a switching module during the FCB test or the load rejection test to replace an actual steam flow. A deviation between the converted steam flow value and the set value can be manually corrected according to actual operating conditions, a rate limit module distinguishes a feedforward rate range under 50% test condition from a feedforward rate range under 100% test condition, and upper limits of the rate ranges are defined according to a maximum steam production per ton of standard coal. The feed water control system vaguely determines the steam flow, to reduce influence of the false water level and maintain stability of the feed water control system.

The converted steam flow of the design total fuel amount of the boiler replacing the actual steam flow is based on a first law of thermodynamics. Pulverized coal is burned in the boiler to heat water in the steam drum of the boiler to produce steam with a certain temperature and pressure, and chemical energy of fuel is converted into internal energy of the steam, and an expression (1) for energy conversion is:

$$\Delta U = W + Q \tag{1}$$

In which ΔU represents an amount of change in the internal energy, takes a positive value upon increasing and takes a negative value upon decreasing; Q represents heat, takes a positive value upon heat absorption and takes a negative value upon heat release; W represents power, takes a positive value when work is done by a thermodynamic system, and takes a negative value when the thermodynamic system does work to the surroundings.

A boiler thermal efficiency η is introduced in a process of calculating steam production per ton of standard coal, the expression (1) is simplified as follows:

$$\Delta U = Q * \eta \tag{2}$$

In which ΔU is total internal energy absorbed in conversion from water to steam; Q is a total calorific value of coal; η is a thermal efficiency, and an expression for steam production per ton of standard coal is.

$$Q(\text{ton})/\Delta U(\text{ton}) * \eta = \text{steam production per ton of standard coal.} \tag{3}$$

Under different pressures and temperatures, thermal properties of saturated water vapor are different, and a heat required to produce one ton of saturated steam under different conditions is also different, and c based on a saturated steam enthalpy value table.

Under different loads of the boiler, the steam production per ton of standard coal is calculated, and a coal-steam flow conversion function is corrected, to effectively improve accuracy of the function, reduce influence of the false water level on a boiler steam system during the FCB or load rejection test of the boiler, and maintain controllability of the steam drum water level during the FCB or load rejection test.

For example, an enthalpy value of saturated steam with a pressure of 13 MPa is about 2661.8 kJ/kg, an enthalpy value of water at a room temperature and an atmospheric pressure is about 84 kJ/kg, a design coal type of the boiler is bituminous coal of 20930 kJ/kg, a thermal efficiency of the boiler is 80%, and the above values are substituted into the expression (2), then the following expression can be obtained.

$$\text{steam production per ton of standard coal} = \frac{2093000\ \text{kJ}/t}{2661800\ \text{kJ}/t - 84000\ \text{kJ}/t} * 80\% \approx 6.5t$$

The present disclosure provides a feedforward structure for controlling a steam drum water level in a steam turbine FCB test, and a control method therefor. By switching feedforward steam flow by the feed water control system, the feedforward structure can effectively prevent influence of the "false water level" caused by drastic change of the main steam pressure, on the water level control, during the FCB working condition or load rejection test. Through the disclosure, the feed water control system automatically adapts to the FCB working condition or load rejection test, avoiding large fluctuations of feed water flow caused by the turbine unit FCB or load rejection, meeting requirements of the turbine unit FCB or load rejection. The present disclosure has high safety, good reliability, and a simple structure.

Where SP denotes a set point, which is a set value of a steam drum water level; PV denotes a process value, which is a measured value of the steam drum water level; PID denotes a control module, the steam drum water level is controlled in a cascade three-impulse control mode; Σ is a symbol of addition operation, which is drawn with reference to SAMA diagrams; F denotes fuel amount; F(X) denotes conversion function; LIM denotes rate limit; T denotes steam flow; 1 denotes steam flow measurement sensor; 2 denotes steam drum water level measurement sensor; 3 denotes feed water flow measurement sensor; 4 denotes actuator; 5 denotes feed water pipe; 6 denotes steam drum.

DETAILED DESCRIPTION OF THE EMBODIMENTS

The technical solutions of the disclosure will be further described in detail below with embodiments and reference to the accompanying drawings.

Figure 1:
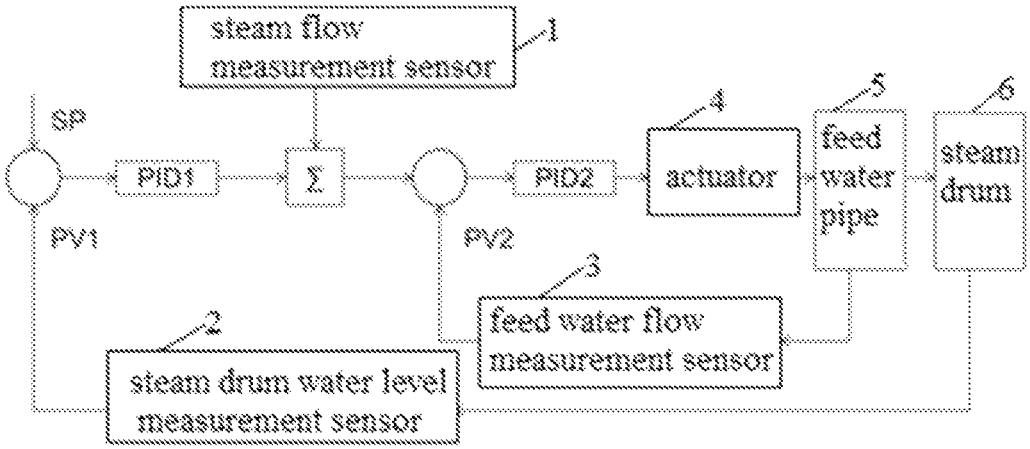
FIG. 1 is a structural diagram showing three-impulse regulation of a steam drum water level according to the present disclosure.
Figure 2:
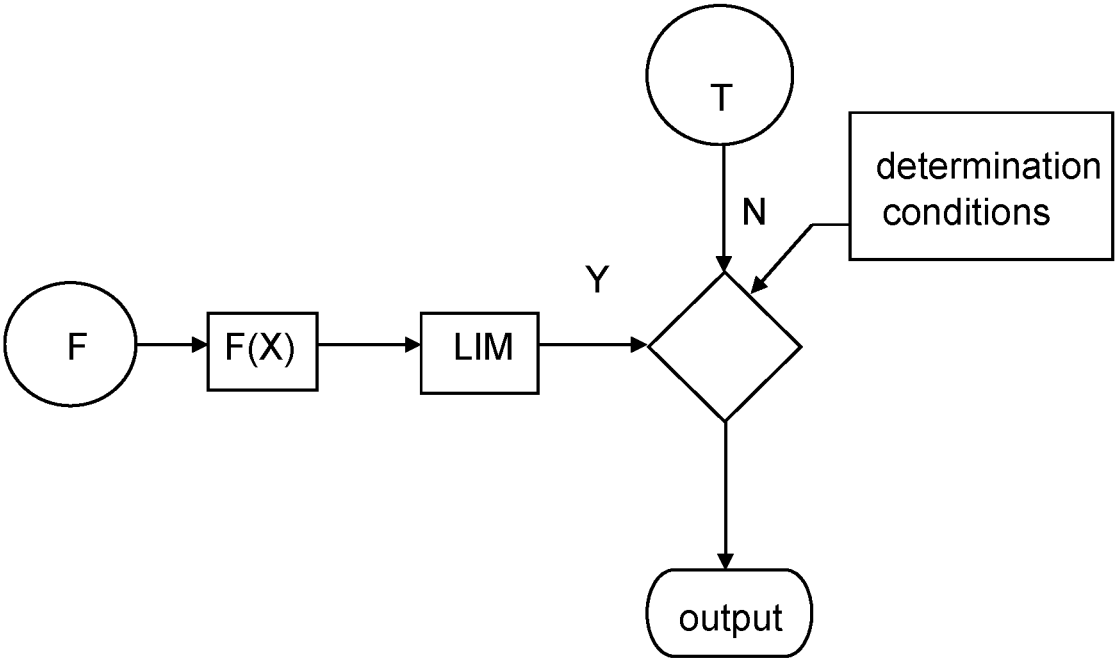
FIG. 2 is a structural diagram showing feedforward switching according to the present disclosure.

Embodiment 1: as shown in FIGS. 1 and 2, a feedforward structure for controlling a steam drum water level in a steam turbine FCB test includes a steam drum 6 provided with a steam drum water level measurement sensor 2 therein, a feed water pipe 5 provided with a feed water flow measurement sensor 3 therein, and a steam inlet pipe provided with a steam flow measurement sensor 1 therein. A steam drum water level measurement value I in the steam drum water level measurement sensor 2 is compared with a set value of a steam drum water level.

The steam drum water level measurement sensor 2 generates a main signal, any changes in the water level caused by disturbances change an output signal of a regulator to change a feed water flow, so as to restore the water level to the set value.

The steam flow measurement sensor 1 generates a feedforward signal, which prevents the regulator from performing an erroneous operation due to a false water level, and improves regulation quality when a steam flow is disturbed.

The feedforward signal representing the steam flow and a signal representing the feed water flow work together to eliminate a static deviation of the feed water control system.

When a feed water flow changes, a differential pressure between a first pressure of a measuring device before the feed water flow is to be changed and a second pressure of the measuring device after the feed water flow is changed, changes quickly, and a change in the feed water flow is reflected in time. Therefore, the feed water flow signal is used as a media feedback signal, so that the regulator can eliminate internal disturbances based on a feedforward signal when the water level has not changed, to enable an adjustment process stable, thereby having a function of stabilizing the feed water flow.

A control method for the feedforward structure for controlling steam drum water level in steam turbine FCB test, and the method includes the following steps of:

Quickly closing a steam inlet control valve by triggering an overspeed protection control (OPC) function at a side of the steam turbine in advance, quickly opening high and low pressure bypasses, and opening a pressure control valve at a side of a boiler during the FCB test of the steam turbine or a load rejection test, such that a main steam pressure at the side of the steam turbine rises sharply and then drops sharply which causes the steam drum water level to rise rapidly, resulting in the false water level, wherein in a case that the steam drum water level is controlled in a conventional three-impulse mode, the feed water control system quickly reduces water supply, such that the steam drum water level rises briefly and then drops to a dangerous water level sharply, the steam flow feedforward by the feed water control system is switched to a converted steam flow based on a design total fuel amount through a switching module during the FCB test or the load rejection test to replace an actual steam flow; a deviation between the converted steam flow value and the set value can be manually corrected according to actual operating conditions, a rate limit module distinguishes a feedforward rate range under 50% test condition from a feedforward rate range under 100% test condition, and upper limits of the rate ranges are defined according to a maximum steam production per ton of standard coal. The feed water control system vaguely determines the steam flow, to reduce influence of the false water level and maintain stability of the feed water control system.

Wherein the converted steam flow of the design total fuel amount of the boiler replacing the actual steam flow is based on a first law of thermodynamics; pulverized coal is burned in the boiler to heat water in the steam drum 6 of the boiler to produce steam with a certain temperature and pressure, and chemical energy of fuel is converted into internal energy of the steam, and an expression (1) for energy conversion is:

$$\Delta U = W + Q \quad (1)$$

Wherein ΔU represents an amount of change in the internal energy, takes a positive value upon increasing and takes a negative value upon decreasing; Q represents heat, takes a positive value upon heat absorption and takes a negative value upon heat release; W represents power, takes a positive value when work is done by a thermodynamic system, and takes a negative value when the thermodynamic system does work to the surroundings.

A boiler thermal efficiency 11 is introduced in a process of calculating steam production per ton of standard coal, as a burning process in the boiler is complex and doing work is extremely difficult to mathematically characterized, the expression (1) is simplified as follows:

$$\Delta U = Q * \eta \quad (2)$$

Wherein ΔU is total internal energy absorbed in conversion from water to steam; Q is a total calorific value of coal; η is a thermal efficiency, and an expression for steam production per ton of standard coal is:

$$Q(\text{ton})/\Delta U(\text{ton}) * \eta = \text{steam production per ton of standard coal} \quad (3)$$

Wherein under different pressures and temperatures, thermal properties of saturated water vapor are different, and a heat required to produce one ton of saturated steam under different conditions is also different, and c based on a saturated steam enthalpy value table.

Wherein under different loads of the boiler, the steam production per ton of standard coal is calculated, and a coal-steam flow conversion function is corrected, to effectively improve accuracy of the function, reduce influence of the false water level on a boiler steam system during the FCB or load rejection test of the boiler, and maintain controllability of the steam drum water level during the FCB or load rejection test.

What is claimed is:

1. A feedforward structure for controlling steam drum water level in steam turbine fast cut back (FCB) test, comprising: a steam drum provided with a steam drum water level measurement sensor therein, a feed water pipe provided with a feed water flow measurement sensor therein, and a steam inlet pipe provided with a steam flow measurement sensor therein; wherein a steam drum water level measurement value I in the steam drum water level measurement sensor is compared with a set value of the steam drum water level;

the steam drum water level measurement sensor generates a main signal, any change of the steam drum water level caused by disturbances changes an output signal of a regulator to change a feed water flow, so as to restore the steam drum water level to the set value;

the steam flow measurement sensor generates a feedforward signal, which prevents the regulator from performing an erroneous operation due to a false water level, and improve regulation quality when a steam flow is disturbed;

the feedforward signal representing the steam flow and a signal representing the feed water flow work together to eliminate a static deviation of a feed water control system;

when the feed water flow changes, a differential pressure of a transmitter changes quickly and reflects the change of the feed water flow in time; a feed water flow signal representing the feed water flow is used as a media feedforward signal, based on which the regulator eliminates internal disturbances when the steam drum water level has not changed, such that a regulation process by the regulator is stable and the feed water flow is stabilized.

2. A control method for the feedforward structure for controlling steam drum water level in steam turbine FCB test according to claim 1, comprising the following steps of:

closing a steam inlet control valve by triggering an overspeed protection control (OPC) function at a side of the steam turbine in advance, opening high and low pressure bypasses, and opening a pressure control valve at a side of a boiler during the FCB test of the steam turbine or a load rejection test, such that a main steam pressure at the side of the steam turbine rises and then drops which causes the steam drum water level to rise, resulting in the false water level, wherein the steam flow feedforward by the feed water control system is switched to a converted steam flow based on a design total fuel amount through a switching module during the FCB test or the load rejection test to replace an actual steam flow; a deviation between the steam flow converted value and the set value can be manually corrected according to actual operating conditions, a rate limit module distinguishes a feedforward rate range under 50% test condition from a feedforward rate range under 100% test condition, and upper limits of the rate ranges are defined according to a maximum steam production per ton of standard coal, the feed water control system determines the steam flow, to reduce influence of the false water level and maintain stability of the feed water control system;

wherein pulverized coal is burned in the boiler to heat water in the steam drum of the boiler to produce steam with a certain temperature and pressure, and chemical energy of fuel is converted into internal energy of the steam, and an expression (1) for energy conversion is:

$$\Delta U = W + Q \quad (1)$$

wherein ΔU represents an amount of change in the internal energy, takes a positive value upon increasing and takes a negative value upon decreasing; Q represents heat, takes a positive value upon heat absorption and takes a negative value upon heat release; W represents power, takes a positive value when work is done by a thermodynamic system, and takes a negative value when the thermodynamic system does work to the surroundings;

a boiler thermal efficiency η is introduced in a process of calculating steam production per ton of standard coal, the expression (1) is simplified as follows:

$$\Delta U = Q * \eta \quad (2)$$

wherein ΔU is total internal energy absorbed in conversion from water to steam; Q is a total calorific value of coal; η is a thermal efficiency, and an expression for steam production per ton of standard coal is:

$$Q(\text{ton})/\Delta U(\text{ton}) * \eta = \text{steam production per ton of standard coal} \quad (3)$$

wherein under different pressures and temperatures, thermal properties of saturated water vapor are different, and a heat required to produce one ton of saturated steam under different conditions is also different, and c based on a saturated steam enthalpy value table;

wherein under different loads of the boiler, the steam production per ton of standard coal is calculated, and a coal-steam flow conversion function is corrected, to effectively improve accuracy of the function, reduce influence of the false water level on a boiler steam system during the FCB or load rejection test of the boiler, and maintain controllability of the steam drum water level during the FCB or load rejection test.

* * * * *